United States Patent [19]

Suzuki et al.

[11] Patent Number: 4,833,361

[45] Date of Patent: May 23, 1989

[54] IMPREGNATED CATHODE HAVING CATHODE BASE BODY AND REFRACTORY METAL SUPPORT WELDED TOGETHER

[75] Inventors: Yukio Suzuki; Masaharu Kumada, both of Mobara, Japan

[73] Assignee: Hitachi, Ltd., Tokyo, Japan

[21] Appl. No.: 92,143

[22] Filed: Sep. 2, 1987

[30] Foreign Application Priority Data

Sep. 3, 1986 [JP] Japan ..... 61-205986

[51] Int. Cl.[4] ..... H01J 1/28

[52] U.S. Cl. ..... 313/346 R; 313/346 DC

[58] Field of Search ..... 313/346 R, 346 DC

[56] References Cited

FOREIGN PATENT DOCUMENTS 2188771A 10/1987 United Kingdom ..... 313/346 DC

*Primary Examiner*—Kenneth Wieder

*Attorney, Agent, or Firm*—Antonelli, Terry & Wands

[57] ABSTRACT

An impregnated cathode which has a portion where no electron emissive material is present on the surface layer of the cathode base body that is to be welded, in order that the cathode base body impregnated with the electron emissive material, a cup and a cathode sleeve can be firmly welded together. The cathode base body which has no electron emissive material on the surface layer is obtained by washing the cathode base body in a solvent which is capable of dissolving the electron emissive material. Using this cathode base body, the impregnated cathode is fabricated.

8 Claims, 1 Drawing Sheet

IMPREGNATED CATHODE HAVING CATHODE BASE BODY AND REFRACTORY METAL SUPPORT WELDED TOGETHER

BACKGROUND OF THE INVENTION

The present invention relates to an impregnated cathode used as a high current density cathode in an electron tube and to a process for producing the same.

An impregnated cathode used as a high current density cathode comprises a cathode base body made of a porous refractory metal such as tungsten (W), molybdenum (Mo) or the like impregnated with an electron emissive material such as a barium-calcium aluminate; a cup composed of a refractory metal such as tantalum (Ta), molybdenum or the like; and a cathode sleeve composed of a refractory metal such as tantalum, molybdenum or the like. The cathode base body is mounted on the cup, and the cup on which the cathode base body is mounted is inserted in the top portion of the cathode sleeve which is irradiated with a laser beam from the side thereof, such that the cathode sleeve, the cup and the cathode base body are welded together.

The cathode base body is composed of tungsten having a melting point of 3370° C., and the cup and the cathode sleeve are composed of tantalum having a melting point of 2940° C. or molybdenum having a melting point of 2617° C. To weld them together, therefore, the welding portion must be heated at a temperature higher than the melting point of at least either one of the metals. However, the electron emissive material with which the cathode base body is impregnated has a melting point of about 1700° C. During the welding, therefore, the electron emissive material melts and vaporizes, so that a hole is formed in the welding portion.

When the impregnated cathode was tested for its life being incorporated in an electron tube, the cutoff voltage changed greatly. The electron tube therefore was disassembled and investigated, and it was found that the cathode base body was split off from the cup and the sleeve even with a small force.

In order to cope with the above-mentioned problem, Japanese Patent Laid-Open No. 10823/1984 discloses a method in which a welding member is interposed between the cathode base body and the cup, and Japanese Patent Laid-Open No 111222/1984 discloses a method in which recessed portions are formed in the side walls of the cathode base body, and portions of the cup and the cathode sleeve corresponding to the recessed portions are irradiated with the laser beam, and protrusions of the cup and the cathode sleeve formed as they are melted are fitted to the recessed portions thereby to firmly hold the cathode base body.

These methods are to improve the existing method as it is difficult to directly weld together the cup, the cathode sleeve and the cathode base body composed of porous tungsten impregnated with the electron emissive material. Even with these methods, however, these members are not firmly adhered together.

SUMMARY OF THE INVENTION

The object of the present invention is to provide an impregnated cathode in which the cathode base body, cup and sleeve are firmly welded together, and a process for easily producing the same, eliminating the difficulties involved in the aforementioned prior art.

According to the impregnated cathode of the present invention, the electron emissive material does not exist on the surface layer of at least a portion where the welding will be effected on the cathode base body composed of a porous sintered body of a refractory metal impregnated with the electron emissive material.

A process for producing the impregnated cathode of the present invention has a step for removing the electron emissive material from the surface layer by washing the cathode base body in a solvent in which the electron emissive material dissolves prior to welding the cathode base body.

Examples of the solvent for dissolving the electron emissive material include pure water, acetic acid-containing aqueous solution, and the like. Washing conditions such as washing time, washing method and temperature of the solvent, differ depending upon the kind of solvent that is used. Therefore, simple experiments should be carried out for each of the solvents to determine the washing conditions in advance, and the washing should be carried out in accordance with such conditions.

According to the present invention, the electron emissive material does not exist on a portion of the cathode base body on which the welding is to be effected, and there takes place no vaporization of the electron emissive material during the welding. Furthermore, the cathode base body, cup and cathode sleeve are directly and sufficiently welded together, to eliminate the aforementioned difficulties involved in the conventional art.

DESCRIPTION OF THE PREFERRED EMBODIMENTS

An embodiment of the invention will now be described in detail in conjunction with the drawings.

Figure 1A:
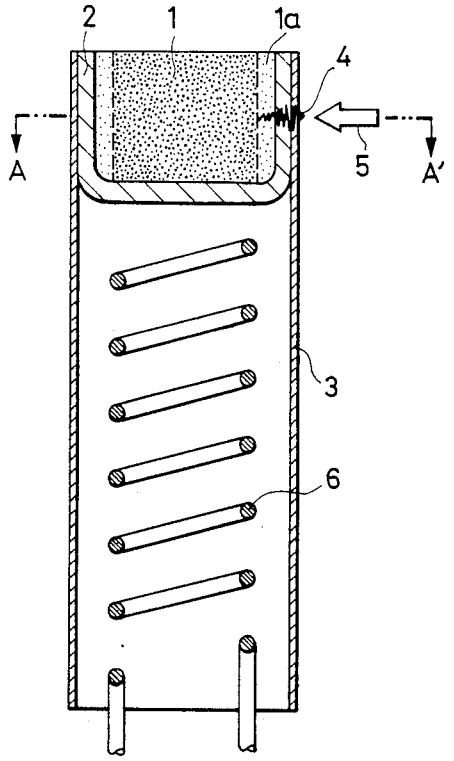
FIG. 1*a* is a section view of an impregnated cathode according to an embodiment of the present invention.
Figure 1B:
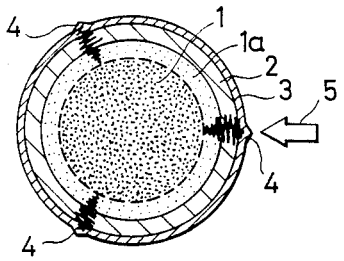
FIG. 1*b* is a section view of the impregnated cathode along the line A—A' of FIG. 1*a;*

FIG. 1*a* is a vertical section view illustrating an impregnated cathode according to an embodiment of the present invention, and FIG. 1*b* is a section view oI along the line A—A' of FIG. 1*a.* In FIGS. 1*a* and 1*b,* reference numeral 1 denotes a nearly pelletized cathode base body composed of a porous sintered body of a refractory metal such as tungsten which is impregnated with an electron emissive material. A porous tungsten portion 1*a* which is not impregnated with the electron emissive material is formed on the surface layer of the cathode base body 1, except the electron emissive surface, as a unitary structure and, particularly on the side surface layer of the sleeve side over a depth of 20 to 50 $\beta$m. Reference numeral 2 denotes a cup composed of a refractory metal such as tantalum (hereinafter referred to as cup) to contain the cathode base body 1, reference numeral 3 denotes a cathode sleeve composed of tantalum (hereinafter referred to as sleeve) which supports the cup 2 at the upper portion thereof, 4 denotes a welding portion where the cathode base body 1, the cup 2 and the sleeve 3 are welded together as a unitary structure being irradiated with a laser beam 5, and reference numeral 6 denotes a heater which is arranged in the sleeve 3 to heat the cathode base body 1 so that electrons are emitted.

When the surface layer of the cathode base body that is not impregnated with the electron emissive material has a thickness which is smaller than 10 μm, the effect of the present invention decreases objectionably.

Described below is a process for producing the thus constructed impregnated cathode.

First, a porous base body obtained by press-molding a tungsten powder is sintered in a reducing atmosphere, and the porous base body is impregnated with a widely known electron emissive material composed of a barium compound, a calcium compound and an aluminate to obtain a starting base body having a predetermined size. Next, the starting base body is immersed in pure water contained in a vessel, and the electron emissive material is removed therefrom for a predetermined period of time (about 10 minutes) by applying ultrasonic waves of an output of 300 watts at a predetermined temperature (about 20° C.). Thereafter, water is removed from the base body with an organic solvent such as alcohol, followed by the heat treatment at about 200° C. in a hydrogen atmosphere. Then, predetermined surfaces such as upper and lower surfaces, except the side surfaces, are polished to form a cathode base body 1. As a result, the electron emissive material is removed from the front surface layer (about 20 to 50 μm thickness, and 35 μm in this embodiment) except the electron emissive surface of the cathode base body 1, and whereby a porous tungsten portion 1*a* is formed as shown in FIGS. 1*a* and 1*b*. Next, the thus formed cathode base body 1 is contained in the cup 2 which is mounted on the sleeve 3. The welding portion 4 is then irradiated with a laser beam 5 using a laser welder having an electrostatic capacity of 500 μF and a lamp voltage of 870 V to effect the welding, thereby to fabricate an impregnated cathode. The sleeve 3 contains a heater 6, as a matter of course.

Figure 2A:
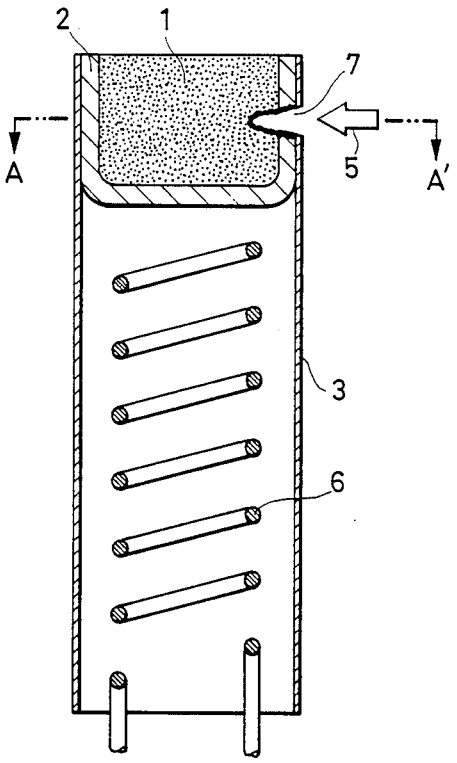
FIG. 2a PRIOR ART
FIG. 2*a* is a section view of an impregnated cathode according to a conventional art.
Figure 2B:
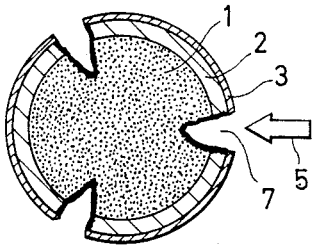
FIG. 2b PRIOR ART
FIG. 2*b* is a section view of the impregnated cathode along the line A—A' of FIG. 2*a.*

Observation of the welding portion 4 through a scanning electron microscope indicated that the thus produced impregnated cathode did not permit the electron emissive material to be vigorously vaporized even when it was irradiated with the laser beam 5 and made it possible to reliably prevent a hole 7 from forming in the welding portion 4 unlike those of the conventional art shown in FIGS. 2*a* and 2*b*. Furthermore, when cut sectionally, it was revealed that the welding portion 4 shown in FIGS. 1*a* and 1*b*. had been welded firmly and desirably. The impregnated cathode was mounted on the cathode-ray tube and its emission characteristics were evaluated. It was confirmed that no adverse effect had been developed at all.

In the above-mentioned embodiment, furthermore, the electron emissive material was removed from the surface layer of the cathode base body by the method of ultrasonic wave irradiation in pure water. The electron emissive material, however, may be removed in a solution which contains acid such as acetic acid, or may be removed by any other method provided it does not adversely affect the emission characteristics.

In the above-mentioned embodiment, furthermore, the cathode base body, the cup and the sleeve were firmly welded together as a unitary structure. The invention, however, is in no way limited thereto only. For example, the cathode base body and the cup may be firmly welded together, or the cathode base body and the sleeve may be firmly welded together to constitute the impregnated cathode that exhibits quite the same effects as those mentioned above.

According to the present invention as described above no electron emissive material is made present on the surface layer of a portion where the welding is to be effected on the cathode base body composed of a porous sintered body of a refractory metal impregnated with the electron emissive material. During the welding, therefore, the electron emissive material of the cathode base body does not melt or vaporize, and no hole is formed. Accordingly, the cathode base body is firmly adhered onto a support of refractory metal (cup and/or cathode sleeve), and the impregnated cathode of a high quality is obtained. Prior to welding the cathode base body and refractory metal support together, furthermore, the starting base body is washed in a solvent in which the electron emissive material dissolves. Thus, there is easily obtained the cathode base body which has no electron emissive material on the surface layer, making it possible to produce the impregnated cathode of a high quality maintaining good productivity.

What is claimed is:

1. In an impregnated cathode comprising a cathode base body which is composed of a porous sintered body of a refractory metal impregnated with an electron emissive material, and a refractory metal support to firmly support said cathode base body, the improvement wherein said cathode base body is impregnated with said electron emissive material over the regions except a surface layer of at least a portion where said cathode base body will be welded to said refractory metal support.

2. An impregnated cathode according to claim 1, wherein said refractory metal support consists of a cup and a cathode sleeve, and said cathode base body, said cup and said cathode sleeve are welded together.

3. An impregnated cathode according to claim 1, wherein the surface layer of said cathode base body has a thickness which is greater than 10 μm.

4. An impregnated cathode according to claim 1, wherein said porous sintered body is composed of tungsten.

5. An impregnated cathode according to claim 1, wherein said refractory metal support is composed of tantalum or molybdenum.

6. An impregnated cathode according to claim 1, wherein said cathode base body is impregnated with said electron emissive material over the regions except the side surface layer of said refractory metal support side.

7. An impregnated cathode according to claim 1, wherein the surface layer of said cathode base body has a thickness of 20–50 μm.

8. An impregnated cathode according to claim 2, wherein said cathode base body, said cup and said cathode sleeve are welded together as a unitary structure.

* * * * *